US010704509B2

(12) United States Patent
Farouk et al.

(10) Patent No.: US 10,704,509 B2
(45) Date of Patent: Jul. 7, 2020

(54) METHODOLOGY AND SYSTEM FOR REFORMING LIQUID FUEL

(71) Applicant: University of South Carolina, Columbia, SC (US)

(72) Inventors: Tanvir Farouk, Irmo, SC (US); Frederick L. Dryer, St. Augustine, FL (US); Sang Hee Won, Irmo, SC (US)

(73) Assignee: University of South Carolina, Columbia, SC (US)

( * ) Notice: Subject to any disclaimer, the term of this patent is extended or adjusted under 35 U.S.C. 154(b) by 57 days.

(21) Appl. No.: 15/472,381

(22) Filed: Mar. 29, 2017

(65) Prior Publication Data

US 2017/0292479 A1 Oct. 12, 2017

Related U.S. Application Data

(60) Provisional application No. 62/319,324, filed on Apr. 7, 2016.

(51) Int. Cl.

| | |
|---|---|
| ***F02M 27/04*** | (2006.01) |
| ***F02M 27/06*** | (2006.01) |
| ***C10L 1/02*** | (2006.01) |
| ***C10L 1/08*** | (2006.01) |
| ***C10G 32/04*** | (2006.01) |

(52) U.S. Cl.

CPC ..... *F02M 27/042* (2013.01); *C10G 32/04* (2013.01); *C10L 1/023* (2013.01); *C10L 1/026* (2013.01); *C10L 1/08* (2013.01); *F02M 27/06* (2013.01)

(58) Field of Classification Search

CPC ..... F02M 27/042; F02M 27/06; C10L 1/023; C10L 1/026; C10L 1/08; C10G 32/04

See application file for complete search history.

(56) References Cited

U.S. PATENT DOCUMENTS

| | | | | |
|---|---|---|---|---|
| 4,726,336 A * | 2/1988 | Hoppie | F02P 23/04 | 123/143 B |
| 6,719,817 B1 * | 4/2004 | Marin | B01J 7/00 | 422/225 |
| 2006/0283175 A1 * | 12/2006 | Cho | C10L 1/02 | 60/286 |

(Continued)

FOREIGN PATENT DOCUMENTS

| | | | | |
|---|---|---|---|---|
| CN | 1796502 A * | 7/2006 | | |
| GB | 9826463 * | 1/1999 | B01D 53/229 | |

OTHER PUBLICATIONS

Effects of UV light, 2014, ADL Petroleum Services, p. 1.*

(Continued)

*Primary Examiner* — Jacob M Amick
*Assistant Examiner* — Charles Brauch
(74) *Attorney, Agent, or Firm* — Dority & Manning, P.A.

(57) ABSTRACT

An on the fly fuel reformer device to produce variations in the autoignition and burning rate properties of a fuel by appropriate processing of some or all of a single fuel supply in its liquid form. The system includes a non-thermal plasma generator and/or a UV radiation source in contact with a fuel line so as to contact a multi-phase fuel in the line and dynamically modify the fuel to exhibit desired autoignition characteristics and burn rate such that the engine can operate with increased efficiency and lower emissions.

17 Claims, 4 Drawing Sheets

(56) References Cited

U.S. PATENT DOCUMENTS

2010/0224322 A1* 9/2010 Sui ..... G01N 21/68
156/345.25
2012/0321523 A1* 12/2012 Shimoda ..... F01N 3/0842
422/168
2014/0366821 A1* 12/2014 David ..... F01L 1/344
123/90.15

OTHER PUBLICATIONS

Wayback Machine, May 29, 2014, adl.uk.net/Effects-of-UV-light.html, pp. 1-3.*
Onishi, Shigeru, et al. Active thermo-atmosphere combustion (ATAC)—a new combustion process for internal combustion engines. No. 790501. SAE Technical Paper, 1979.
Kokjohn, Sage L., et al. "Experiments and modeling of dual-fuel HCCI and PCCI combustion using in-cylinder fuel blending." SAE International Journal of Engines 2.2009-01-2647 (2009): 24-39.
Splitter, Derek, Rolf D. Reitz, and Reed Hanson. "High efficiency, low emissions RCCI combustion by use of a fuel additive." SAE International Journal of Fuels and Lubricants 3.2010-01-2167 (2010): 742-756.
Farouk, T., et al. "Simulation of Atmospheric Pressure Non-Thermal Plasma Discharges for Surface Decontamination Applications." Plasma Assisted Decontamination of Biological and Chemical Agents Springer Netherlands, 2008. 285-294.
Masurier, Jean-Baptiste, et al. "Investigation of iso-octane combustion in a homogeneous charge compression ignition engine seeded by ozone, nitric oxide and nitrogen dioxide." Proceedings of the Combustion Institute 35.3 (2015): 3125-3132.
Won, Sang Hee, et al. "Self-sustaining n-heptane cool diffusion flames activated by ozone." Proceedings of the Combustion Institute 35.1 (2015): 881-888.
F. Alam, F Dryer, T. Farouk, Ozone assisted "Cool Flame" combustion of sub-millimeter n-heptane droplets at atmospheric and higher pressure, in: 9th US National Combustion Meeting, Cincinnati, Ohio, 2015.
Fridman, Alexander, and Lawrence A. Kennedy. Plasma physics and engineering. CRC press, 2004.
Charchi, Ali, and Tanvir Farouk. "A two-phase multi-physics model for simulating plasma discharge in liquids." APS Meeting Abstracts. vol. 1. 2014.

* cited by examiner

METHODOLOGY AND SYSTEM FOR REFORMING LIQUID FUEL

CROSS REFERENCE TO RELATED APPLICATION

This application claims filing benefit of U.S. Provisional Patent Application Ser. No. 62/319,324 having a filing date of Apr. 7, 2016, entitled "Methodology and System for Reforming Liquid Fuel to Tailor Engine Combustion and Emission Properties," which is incorporated by reference herein for all purposes.

BACKGROUND

Internal combustion reciprocating (and/or linear) piston engines operating with a compression ignition (CI) design compress the fuel and oxidizer to the point of auto-ignition rather than using a spark ignition as is common in gasoline engines. In the homogeneous charge compression ignition (HCCI) mode the fuel and oxidizer are well mixed prior to compression. In the stratified charge compression ignition (SCCI) mode the fuel is injected during the compression stroke. In compression ignited systems, the auto-ignition timing is inherently related to the chemical properties of the fuel charge and can also be controlled by the stratification of the charge. Both compression ignition modes can achieve higher energy conversion efficiencies at lower operating temperatures than spark ignition engine operations. HCCI can substantially reduce nitrogen oxide ($NO_x$) emissions without a catalytic converter.

Currently, unburned hydrocarbon particulates and carbon monoxide (CO) emissions from CI systems require post-combustion treatment, but if improvements can continue to be made in these systems, they offer the potential to completely eliminate $NO_x$ and particulate emission after-combustion requirements. For instance, research has shown that the lower operating temperatures of reactivity controlled compression ignition (RCCI) systems can lead to substantial reductions in $NO_x$ emissions over wide load and speed ranges, even to levels such that after-treatment removal of $NO_x$ is no longer needed.

The chemical kinetic properties of ignition systems are frequently characterized by standardized testing methods. In the case of gasolines, these methods produce the octane numbers (ON) including the research octane number (RON) and motored octane number (MON) for the fuel, while the cetane number (CN) is used for characterizing diesel fuels. The engine operating characteristics utilized in standard ASTM test methods for determining these reference indicators are different and specific to each of the above rating numbers. In general, the properties of gasolines are configured to produce higher octane numbers, which indicate that the fuel is resistant to autoignition, while the properties of diesel fuels are configured to produce higher Cetane numbers, indicating an ability to readily ignite. It is well established empirically that the Octane and Cetane scales are inversely proportional to one another. As a result, one approach to improving control of RCCI ignition and burn rates is through formation of a combustible charge for an engine cylinder using a hybrid fuel including a first fuel having a high octane number combined with a second fuel having a high cetane as a means of varying the propensity of the fuel charge to autoignite.

Another more traditional means of varying the autoignition properties of a fuel is through the use of chemical octane or cetane improvers. A historical octane improver is tetraethyl lead, which over time has been removed from consideration due to its lead content. Another is methylcyclopentadienyl manganese tricarbonyl(MMT or MCMT). Common cetane improvers include alkyl nitrates (principally 2-ethylhexyl nitrate, 2-EHN) and di-tert-butyl peroxide (DTBP). Varying the additive level or its effectiveness in modifying the CN or ON properties can be applied to vary the octane or cetane character of a fuel charge, including a hybrid fuel charge.

While the above principles have been supported by experiment, controlling autoignition and burn rate for liquid-fueled RCCI cycles by varying fuel properties on the fly (i.e., continuously during engine performance) according to these known methods would require complex storage of multiple materials on the vehicle (two or more fuel types, fuel additives) and/or the use of the expensive additives as well as a complicated control system to constantly monitor and modify fuel ratios and/or additive amounts.

What are needed in the art are methods and products that can reform fuel so as to better tailor engine combustion and emissions properties. In particular, what are needed are methods and systems that can allow for variation of a single fuel supply to dynamically achieve a range of autoignition and burn rate chemical properties.

SUMMARY

According to one embodiment, disclosed is a method for combusting a fuel that includes contacting a fuel with a non-thermal plasma and/or with UV radiation and thereby chemically and/or physical modifying the fuel and following the contact compressing the modified fuel to an autoignition state.

Also disclosed is a system for combusting a fuel that includes a compression cylinder configured for autoignition of a fuel, a fuel line that is upstream of the compression cylinder and configured to deliver fuel to the compression cylinder, and a reactor configured to produce at least one of a non-thermal plasma and UV radiation, i.e., at least one of a non-thermal plasma generator and a UV radiation source. The reactor is in communication with the fuel line such that a non-thermal plasma and/or UV radiation contacts the fuel carried in the fuel line and thereby modifies the fuel prior to delivery of the fuel to the compression cylinder.

BRIEF DESCRIPTION OF THE DRAWINGS

A full and enabling disclosure of the present subject matter, including the best mode thereof to one of ordinary skill in the art, is set forth more particularly in the remainder of the specification, including reference to the accompanying figures in which.

DETAILED DESCRIPTION

Figure 1:
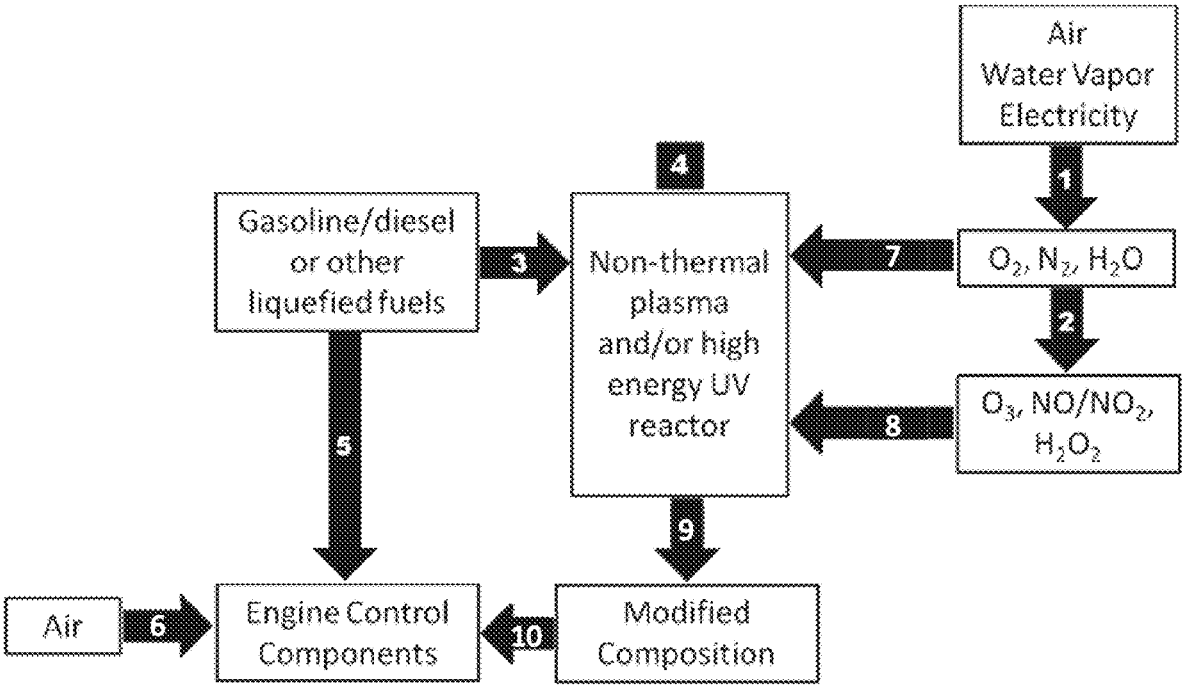
FIG. 1 is a block flow diagram illustrating one embodiment of a fuel reforming method and system as described herein.

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment, may be used in another embodiment to yield a still further embodiment.

In order to achieve a range of operating load/speeds in a compression ignition system, it is necessary to vary the conditions at which auto ignition occurs in the compression stroke and the burn rate that ensues. Controlling these two characteristics provides an approach toward achieving the optimum peak cylinder pressure at the appropriate crank angle timing to result in optimum power output and best specific fuel consumption at different speed/load conditions. Additionally, varying fuel properties may also be a transformative method to improve the starting characteristics of high compression linear free piston engines.

The methodologies and systems described herein apply techniques individually and/or in concert that can modify and control the autoignition propensity and/or burning rate characteristics of a portion or all of a liquid fuel supply. More specifically, the methods can be applied such that chemical properties of a fuel supplied to the compression cylinder of an engine can be controlled dynamically in real time, thus permitting improved operating efficiency at minimum emissions to be attained over a desired load/speed range for the particular engine application.

Disclosed methods and systems utilize active species produced by non-thermal plasma and/or ultraviolet light interactions with fuel, fuel vapor, and/or gases (e.g., air) present within the fuel to achieve chemical and/or physical modifications of the fuel. While plasma methods have been utilized in the past to produce mixtures of hydrogen and fuel, the presently disclosed approach differs as it has not been developed in order to produce hydrogen enrichment of the fuel charge. Rather, the present approach can produce active species other than hydrogen that can alter the first and second stage autoignition chemistry as compared to that of the parent fuel, i.e., the fuel prior to contact with the non-thermal plasma and/or UV radiation.

For example, in one embodiment, reactive species can be formed that can interact with fuel, fuel vapor, and/or gases (e.g., air) in the pre-compression fuel line and thereby reduce the octane number of the fuel charged to the compression cylinder relative to that of the parent fuel. This application may be desirable in an embodiment in which a gasoline is the single fuel supplied to the energy conversion system (e.g., the combustion cylinder), and can be beneficially utilized in providing for in-line variations in the fuel octane number of the charge so as to advance autoignition timing while also increasing burning rate over those properties for the parent fuel. Of course, this is only one possible embodiment of the disclosed methods and systems, and other possible application will be readily apparent to one of skill in the art.

Figure 2:
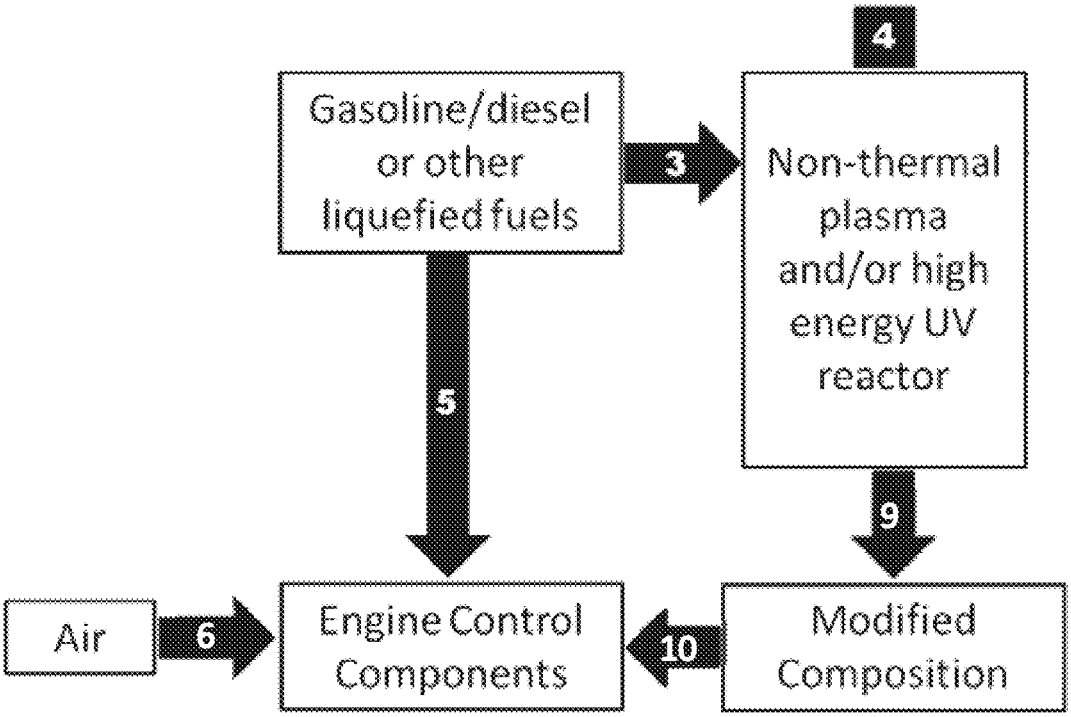
FIG. 2 is a block flow diagram illustrating another embodiment of a fuel reforming method and system as described herein.

FIG. 1 and FIG. 2 illustrate flow diagrams of systems and methods as disclosed herein. As shown, in both embodiments, the method includes feeding an oxidizer (e.g., air) at 6, and a liquefied fuel at 5 to the engine control components of an engine. In addition, a portion of the fuel is fed 3 to a reactor 4 where it is modified 9 prior to being fed 10 to the engine.

The disclosed systems and methods can be used in conjunction with any internal combustion piston cylinder engine including any engine cycle configuration. In one embodiment, the systems can be directed toward use with engines used in transportation, e.g., both low and high speed engines as well as engines for use in any of land, air, and marine vehicles. The disclosure is not limited to transportation engines, however, and the systems and methods can also provide improvement in stationary power applications such as stationary power generation and motive power generation (e.g., compressor or other power generation based upon a liquefied fuel driven compression ignition engine).

Beneficially, the disclosed systems and methods do not involve any new design for the engine utilized with the system. Rather, disclosed systems can be combined with existing engine systems and can synergize with the pre-existing engine configuration to enable RCCI-based methodologies that can achieve high efficiency and low emission operations.

In general, any liquefied fuel as may be utilized in an internal combustion piston cylinder engine can be modified according to the disclosed techniques. In one particular embodiment, a system can be designed for an engine capable of utilizing diesel and/or gasoline as the fuel, for instance a hybrid gasoline/diesel fuel as may be utilized in an RCCI system. In some embodiments, the fuel can include components such as oxygenated species including, without limitation, ethanol, butanol, etc. or other materials that can exhibit high reactivity upon contact with a non-thermal plasma and/or UV radiation as compared to petroleum derived components. For instance, the fuel can include one or more high octane gasolines that include one or more oxygenated species.

As shown in the embodiment illustrated in FIG. 1, a portion of the liquefied fuel is diverted at 3 to a reactor 4 where the fuel is modified by contact with non-thermal plasma and/or UV radiation to form a modified fuel composition 9. Partial diversion of the fuel to the reactor is not a requirement of disclosed techniques, however, and in other embodiments, all of the fuel can be passed through the reactor prior to delivery to the engine control components.

At the reactor 4, the single phase fuel flow can be modified to form a multi-phase flow. The production of a multi-phase fluid flow can create a composition more conducive to processing by application of energy in the form of a non-thermal plasma and/or UV radiation as compared to a single phase liquid flow. For instance, the formation of a multi-phase fluid flow prior to or in conjunction with processing by the non-thermal plasma and/or UV radiation can be beneficial as this can provide plasma nucleation and/or scattering sites within the liquid phase. This is in contrast to the characteristics of a single phase liquid, which typically requires very high breakdown voltage and exhibits very different UV absorption properties.

The multi-phase fluid of the fuel flow at the reactor can include a micro-vapor dispersion (MVD) including a micro-dispersion of vapor bubbles in the fluid, a micro-gas dispersion (MGD) including a micro-dispersion of gas bubbles in the fluid, or a combination thereof, i.e., a micro-gas/micro-vapor dispersion (MGND) that includes both a gas component and a vapor component incorporated in the fuel flow.

In the embodiment of FIG. 1, a gaseous component can be introduced to the single phase fuel flow to the reactor 4 in formation of an MGD or MGND fuel flow. The multi-phase flow can be formed through introduction of nitrogen, oxygen and/or moisture (e.g., air) directly as at 7 and/or through introduction of more highly reactive gases at 9 that can be formed from the air/water constituents. For example, in one embodiment air may be processed to produce dry streams or humidified streams of high oxygen content with or without inert nitrogen In one embodiment, the gas utilized to produce MGD or MG/VD multi-phase fluid in the reactor can contain components obtained or produced from air, and may encompass, without limitation, one or more of high concentrations of oxygen, nitrogen, nitrogen oxides, water vapor, hydrogen peroxide, and/or ozone. The constituents may be produced in one embodiment by processing air using membrane separation technologies or other means to achieve oxygen enrichment. For instance, in one embodiment, all or a portion of the intake air can be processed to form more highly reactive species (e.g., $O_3$, $NO/NO_2$, etc.) and these species can be introduced into the fuel separately or in conjunction with $O_2$, $N_2$, and $H_2O$ from the air. Alternatively, $O_2$, $N_2$, and/or $H_2O$ can be introduced to the fuel prior to contact with the non-thermal plasma and/or UV radiation and then, following this introduction, more highly reactive gas and vapor constituents, e.g., ozone, nitrogen oxides, and/or other products such as peroxides, can be formed via contact of the multi-phase fluid with non-thermal plasma and/or UV irradiation.

In another embodiment, illustrated in FIG. 2, a fuel can be processed by contact with a non-thermal plasma at the reactor 4 without the additional introduction of gaseous or vaporous constituents to the flow line at this point of the process. In this embodiment, an MVD fluid flow can be formed, for instance by use of a venturi approach as discussed in more detail below in conjunction with or prior to contact with the non-thermal plasma and/or UV radiation. In this embodiment, the micro-vapor bubbles in the multi-phase fluid can be formed of constituents of the fuel. For example, in one embodiment the fuel can include a high octane gasoline, such as a gasoline containing oxygenated species such as ethanol or butanols, and upon formation of an MVD, these constituents of the multi-phase fluid can be processed via contact with the non-thermal plasma and/or UV radiation to modify the fuel by production of peroxides, hydro peroxides, aldehydes, and ketones that can then accelerate auto ignition phenomena.

Figure 3:
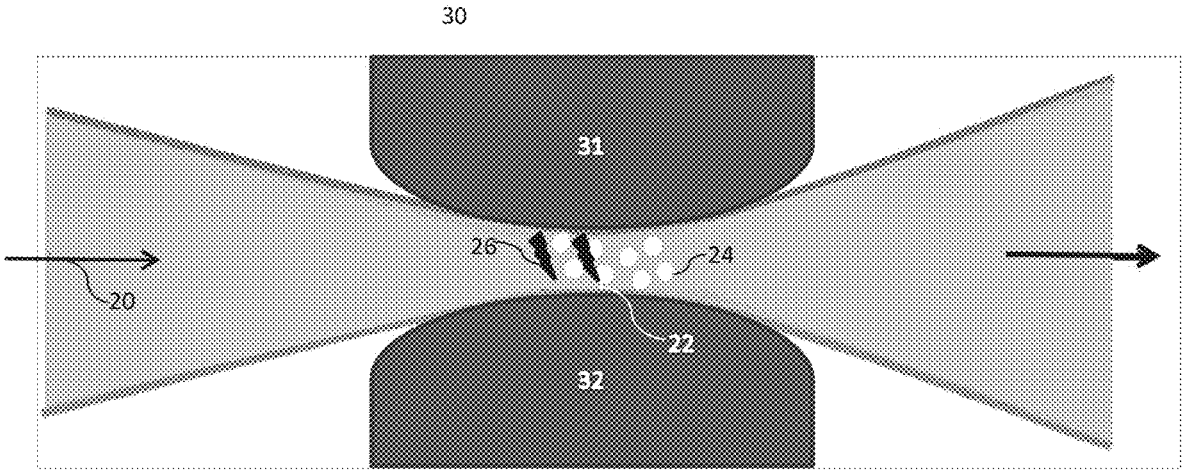
FIG. 3 schematically illustrates one embodiment of a plasma fuel reforming method utilizing a venturi configuration and formation of a micro-vapor dispersion (MVD) multi-phase fluid stream.
Figure 4:
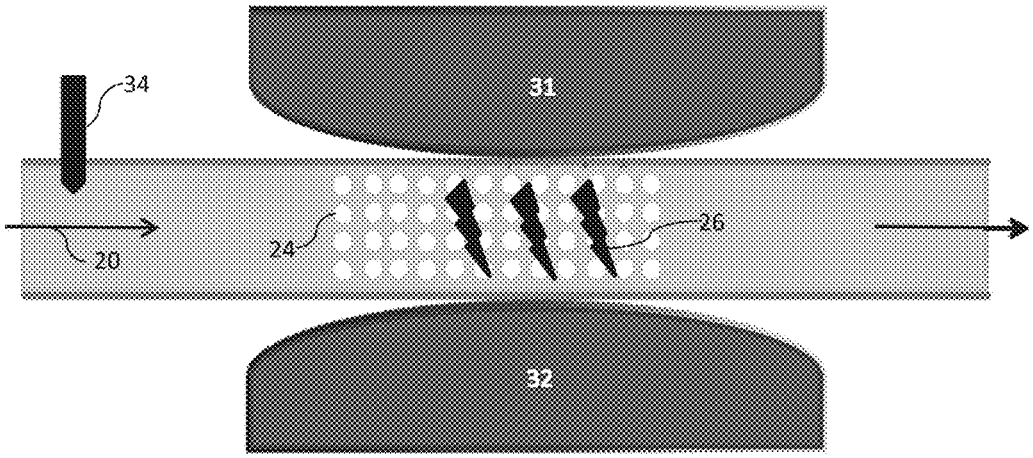
FIG. 4 schematically illustrates one embodiment of a plasma fuel reforming method utilizing a straight tube configuration and formation of a micro-gas dispersion (MGD) multi-phase fluid stream.

Two exemplary configurations of interactions between a fuel flow 20 a non-thermal plasma generator 30 are provided in FIG. 3 and FIG. 4. As shown, at FIG. 3 is disclosed a venturi 22, for instance as may be utilized in an embodiment as illustrated in FIG. 2 that is without external gas addition. In this embodiment, the plasma electrodes 31, 32 can be placed at the vena-contracta. This is not a requirement, however, and in other embodiments, the plasma electrodes may be placed downstream of the vena-contracta.

At the vena-contracta, cavitation will be deliberately created to form the micro-sized gas and/or vapor phase 24 within the liquid phase. For instance, in those embodiments in which an external gas is not added to the fuel, cavitation at the vena-contracta can form micro-vapor bubbles of fuel constituents. Specifically, the pressure gradient across the vena-contracta can produce cavitation and thereby the micro dispersion of vapor bubbles in the fluid.

A venturi can also be utilized in those embodiments in which an external gas and/or vapor is added to the fuel. In this embodiment, the venturi can be utilized to form vapor bubbles in the fluid in addition to those formed of the externally supplied gas, for instance in formation of a MG/VD fluid and/or in decreasing the size of gas bubbles added to the fuel upstream of the venturi.

In the embodiment of FIG. 3, at the vena-contracta and in conjunction with dispersion of the micro-sized bubbles in the fluid, a non-thermal plasma 26 can be formed between the electrodes 31, 32 and applied to the multi-phase fluid. The particular location of contact between a non-thermal plasma and the multi-phase fluid is not a requirement however, and in other embodiments, the non-thermal plasma generator can be downstream of the vena-contracta.

In any case, the physico-chemical properties of the non-thermal plasma discharge can create physical (e.g., induction of electrons and ions) and chemical (e.g., induction of radicals, formation of reactive species) reactions within the vapor/gas phase and the liquid interface of the multi-phase fluid that can modify the fluid composition so as to exhibit different auto ignition properties as compared to the single phase fuel source. For instance, the non-thermal plasma can encourage formation of highly reactive components from externally supplied air as well as formation of radicals of those components. Similarly, the non-thermal plasma can encourage formation of peroxides, hydro peroxides, aldehydes, ketones, etc. from oxygenated species present in the fuel (e.g., butanols, etc.)

At FIG. 4 is illustrated another flow geometry that can produce a multi-phase fluid to which disclosed reforming technologies can be applied. In this embodiment, an externally supplied gas (e.g., air and/or higher reactive species) can be injected upstream 34 of the plasma generator 30, for instance an externally supplied gas including or developed from air as discussed above with reference to FIG. 1. The gas can be added to the fuel flow in any suitable fashion that can form a monodisperse flow of micro-sized gas and/or vapor bubbles in the liquid phase fuel. For instance, a gas injector as is generally known in the art can be utilized to inject one or more of $O_2$, $N_2$, $H_2O$, etc. into the fuel flow for form a multi-phase fluid. Downstream of the gas injection 34 the non-thermal plasma generator 30 can form a plasma 26 that can contact the multi-phase fuel flow and modify the fuel as described.

Figure 5:
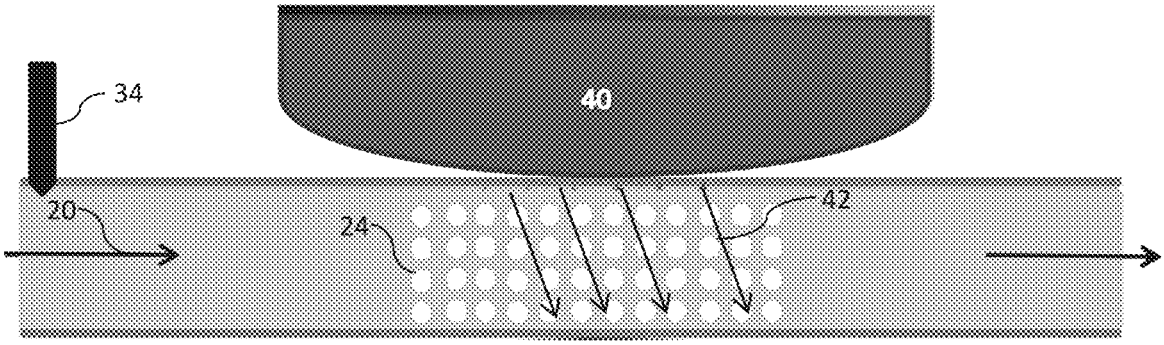
FIG. 5 schematically illustrates one embodiment of a UV fuel reforming method utilizing a straight tube configuration and formation of a MGD multi-phase fluid stream Repeat use of reference characters in the present specification and drawings is intended to represent the same or analogous features or elements of the present disclosure.

FIG. 5 illustrates another embodiment of a system utilizing a straight-tube configuration and an upstream injection 34 of microbubbles 24 to the fuel flow 20. In this embodiment, a UV generator 40 is in optical communication with the multi-phase fluid formed that includes micro-sized gas and/or vapor bubbles. As with a non-thermal plasma, the UV irradiation 42 of the multi-phase fluid can encourage physical and chemical reactions in the fuel so as to dynamically modify the fuel and encourage increased efficiency and lower emission operation of the engine.

A combination of non-thermal plasma generation and fuel contact and UV irradiation of the fuel are also embodied by the present disclosure. For instance, an UV generation and contact system as illustrated in FIG. 5 can be located either upstream or downstream of the non-thermal plasma generator as illustrated in FIG. 3 or FIG. 4.

Referring again to FIG. 1 and FIG. 2, the modified fuel composition issuing from the reactor 4 can be introduced at 10 along with parent fuel 5 and air 6 into the engine during compression to control autoignition timing and burn rate. Any configuration as is generally known in the art for introducing the modified fuel into the engine 10 are encompassed herein and the effectiveness of each can depend upon factors such as the specific engine configuration. It may therefore be beneficial to evaluate not only the fundamental auto ignition and burning rate properties of the plasma/UV processing design, but also the materials that can be produced from processing externally supplied air components, the properties of the modified fuel relative to the original fuel supply and evaluation of the various combinations of these parameters to best integrate with different engine configurations.

In one embodiment, fuel reforming approaches for controlling combustion properties as have been previously described, principal of which utilize thermally driven catalytic pyrolysis and/or partial oxidation approaches can be utilized in conjunction with disclosed methods and systems for additional improvements in the combustion process.

The use of disclosed technologies to produce specific chemical components that can enhance auto ignition properties of can provide benefit to single and hybrid liquid fuels. Applications of the disclosed subject matter have been identified as critical technology needs in ARPA-E's FOA. The successful dissemination of RCCI technologies within multiple sectors has potential for immense impact. A major purpose for applying RCCI techniques is to control the in-cylinder auto ignition timing and burning rate by altering the liquid fuel characteristics (i.e. cetane/octane rating) on the fly, a persisting problem in HCCI. The in-situ control of liquid fuel properties in engines as disclosed herein possesses the simplicity and variability to be a highly disruptive technology. Currently, there are no such technologies in existence that can do on-the-fly-liquid-fuel modifications to control fuel auto ignition and burning rate properties for RCCI engine applications.

While certain embodiments of the disclosed subject matter have been described using specific terms, such description is for illustrative purposes only, and it is to be understood that changes and variations may be made without departing from the spirit or scope of the subject matter.

What is claimed is:

1. A method for combusting a fuel comprising:

diverting a portion of a liquid fuel to a plasma generator;

forming a multi-phase fluid comprising the diverted portion, the multi-phase fluid comprising vapor and/or gas bubbles dispersed in the liquid fuel diverted portion, the vapor and/or gas bubbles comprising one or more of oxygen, nitrogen, water vapor, ethanol, or butanol;

passing the multi-phase fluid between two electrodes of the plasma generator and thereby contacting the multi-phase fluid with a non-thermal plasma, the contact to chemically modifying the multi-phase fluid to form one or more of ozone, a nitrogen oxide, a peroxide, a hydroperoxide, an aldehyde, or a ketone and thereby forming a modified fuel;

combining the modified fuel with a non-diverted portion of the liquid fuel;

introducing the combination into a compression cylinder; and compressing the combination within the compression cylinder, the compressing causing autoignition of the combination.

2. The method of claim 1, wherein the liquid fuel comprises a gasoline.

3. The method of claim 2, wherein the gasoline comprises the ethanol and/or the butanol.

4. The method of claim 1, wherein the liquid fuel comprises a diesel fuel.

5. The method of claim 1, wherein the chemical modification comprises reduction of an octane number of the diverted portion.

6. The method of claim 1, the step of forming the multi-phase fluid comprising introduction of a gaseous component to the diverted portion.

7. The method of claim 6, the gaseous component comprising air.

8. The method of claim 1, the step of forming the multi-phase fluid comprising cavitating the diverted portion.

9. A system for combusting a fuel comprising:

a compression cylinder configured for autoignition of a fuel;

a fuel line upstream of the compression cylinder and configured to deliver fuel to the compression cylinder;

a diversion line splitting off from the fuel line and rejoining the fuel line; and a plasma generator in communication with the diversion line such that a fluid carried in the diversion line passes between two electrodes of the plasma generator and thereby a non-thermal plasma discharged from the plasma generator contacts the fluid carried in the diversion line to form a modified fuel, the plasma generator being located such that the modified fuel is delivered to the fuel line via the diversion line upstream of the compression cylinder.

10. The system of claim 9, wherein the compression cylinder is a component of a gasoline engine.

11. The system of claim 9, wherein the compression cylinder is a component of a diesel engine.

12. The system of claim 9, wherein the diversion line defines a vena contracta, the plasma generator being configured to discharge the non-thermal plasma into the vena contracta.

13. The system of claim 9, further comprising an ultraviolet radiation source.

14. The system of claim 9, further comprising a gas injection module upstream of the plasma generator.

15. The system of claim 9, wherein the system is a component of a transportation vehicle.

16. The system of claim 9, wherein the system is a component of a stationary power generation system.

17. The method of claim 1, further comprising producing the oxygen, nitrogen, or water vapor from air according to a membrane separation process.

* * * * *